US006900412B2

(12) United States Patent
Taniguchi et al.

(10) Patent No.: US 6,900,412 B2
(45) Date of Patent: May 31, 2005

(54) GLOW PLUG

(75) Inventors: Masato Taniguchi, Aichi (JP); Masakazu Nagasawa, Aichi (JP); Nobuyuki Hotta, Aichi (JP); Katsuhiko Tanaka, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/637,572

(22) Filed: Aug. 11, 2003

(65) Prior Publication Data

US 2004/0026399 A1 Feb. 12, 2004

(30) Foreign Application Priority Data

Aug. 12, 2002 (JP) ..... 2002-234619

(51) Int. Cl.[7] ..... F23Q 7/22
(52) U.S. Cl. ..... 219/270; 219/544
(58) Field of Search ..... 219/270, 544; 123/145 A, 145 R

(56) References Cited

U.S. PATENT DOCUMENTS 4,252,091 A * 2/1981 Steinke ..... 123/145 A
5,882,233 A * 3/1999 Idehara ..... 439/877
6,036,829 A * 3/2000 Yamada et al. ..... 219/544
6,433,311 B1 * 8/2002 Teramura et al. ..... 219/270
6,723,959 B2 * 4/2004 Heinz et al. ..... 219/270
2002/0166855 A1 * 11/2002 Renwick et al. ..... 219/544
2002/0175157 A1 * 11/2002 Terada et al. ..... 219/270
2002/0185485 A1 * 12/2002 Radmacher ..... 219/270

FOREIGN PATENT DOCUMENTS

JP 58-000022 * 1/1983
JP 60-103229 * 6/1985
JP 64-046520 * 2/1989
JP 11-002406 * 1/1999

* cited by examiner

*Primary Examiner*—Teresa J. Walberg
(74) *Attorney, Agent, or Firm*—Sughrue Mion, PLLC

(57) ABSTRACT

A glow plug according to one embodiment of the present invention includes a cylindrical metallic shell, an electrode rod disposed in a rear portion of the metallic shell, a heater disposed in a front portion of the metallic shell, and an electric insulator provided between an inner surface of the metallic shell and a circumferential surface of the electrode rod to keep the electrode rod insulated from the metallic shell. The metallic shell has a portion caulked to the electrode rod at a location axially corresponding to the electric insulator so that the circumferential surface of the electrode rod becomes deformed to define therein a recessed portion. The caulked portion is engaged in the recessed portion with the caulked portion with the electric insulator interposed between the caulked portion and the recessed portion, thereby securing the electrode rod in the metallic shell.

24 Claims, 7 Drawing Sheets

GLOW PLUG

BACKGROUND OF THE INVENTION

The present invention relates to a glow plug, particularly of the kind for use in a diesel engine.

Hereinafter, the term "front" refers to a heating end side with respect to the axial direction of a glow plug, and the term "rear" refers to a side opposite the front side.

FIG. 7 shows a conventional-type glow plug 100 that includes a ceramic heater 111 provided with an insulating ceramic substrate 193, a heating element 191 and a pair of electric conductors 195 and 197, a cylindrical metallic shell 113, a metallic sleeve 115, a rod-shaped electrode 117 and a lead wire 199. The ceramic heater 111 is fixed in a front end portion 113*a* of the metallic shell 113 by brazing the metallic sleeve 115 onto the ceramic heater 111 and then brazing the metallic shell 113 onto the metallic sleeve 115. On the other hand, the electrode 117 is fixed in a rear portion of the metallic shell 113 by fitting a ring-shaped glass sealant 121 with a bushing 123 and a securing ring 125. The heating element 191 is embedded in the ceramic substrate 193, and the electric conductors 195 and 197 connect the heating element 191 to the metallic shell 113 and the electrode 117 via the metallic sleeve 115 and the lead wire 199, respectively. Further, a terminal element 119 is fitted on the electrode 117 for connection to an external power source (not shown).

The electrode 117 is generally made of an iron material with rigidity and has a relatively large diameter (of the order of several millimeters) so as to provide not only excellent electrical properties but also resistance to bending. The electrode 117 considerably increases in weight with increase in its length. It is how ver possible to increase the length of the glow plug 100 by producing both the metallic shell 113 and the electrode 117 in increased lengths, so that the glow plug 100 is suitable for use in a direct-injection engine.

SUMMARY OF THE INVENTION

To manufacture the conventional glow plug 100, the electrode 117 is electrically connected to the conductor 197 of the ceramic heater 111 via the lead wire 199, inserted in the metallic shell 113, and then, secured with the glass sealant 121. Because of the above manufacturing process, there is no choice but to fit the glass sealant 121 into a rear end portion of the metallic shell 113. The glow plug 100 is reliant only on the glass sealant 121 for securing the electrode 117 in the metallic shell 113, and the electrode 117 is held only at a rear end portion thereof. Accordingly, the strength for securing the electrode 117 in the metallic shell 113 is inevitably low. The electrode 117 is susceptible to resonance under engine vibrations and/or thermal shocks caused by engine combustion. There arises a possibility that the electrode 117 may have loosened or ruptured due to the resonance to cause a short or break in the electrode 117. The possibility of Such a failure increases with increase in the length of the electrode 117. The length of the electrode 117 cannot be thus increased as desired.

In addition, the glass sealant 121 needs, after being fitted around the electrode 117 and in the metallic shell 113, to be melted by heat and then solidified to secure the electrode 117 In the metallic shell 113. The manufacturing process of the glow plug 100 becomes more complicated due to the heat treatment of the glass sealant 121, which results in high manufacturing cost. The glow plug 100 also has to be designed in consideration of the resistance of each plug component to the heat treatment, and the freedom of glow-plug designing becomes unavoidably limited.

It is therefore an object of the present invention to provide a glow plug capable of securing an electrode in a metallic shell tightly while providing proper Insulation between the metallic shell and the electrode, without the need for heat treatment of a glass sealant material at the final stage in the manufacturing process of the glow plug.

According to a first aspect of the invention, there is provided a glow plug, comprising: a cylindrical metallic shell; an electrode rod disposed in a rear portion of the metallic shell: a heater disposed in a front portion of the metallic shell, the heater having an insulating substrate, a heating element embedded in the insulating substrate and generating heat upon energization thereof, and electric conductors connecting the heating element to the metallic shell and the electrode rod, respectively; a recess formed in a circumferential surface of the electrode rod; a protrusion formed on an inner surf ace of the metallic shell and engaged in the recess to secure the electrode rod in the metallic shell; and an electric insulator interposed between the recess and the protrusion to keep the electrode rod insulated from the metallic shell.

According to a second aspect of the invention, there is provided a glow plug, comprising: a cylindrical metallic shell; an electrode rod disposed in a rear portion of the metallic shell; a heater disposed in a front portion of the metallic shell, the heater having an insulating substrate, a heating element embedded in the insulating substrate and generating heat upon energization thereof, and electric conductors connecting the heating element to the metallic shell and the electrode rod, respectively; and an electric insulator provided between an inner surface of the metallic shell and a circumferential surface of the electrode rod to keep the electrode rod insulated from the metallic shell, wherein the metallic shell is caulked to the electrode rod at a location axially corresponding to the electric insulator so as to cause deformation in the circumferential surface of the electrode rod and thereby secure the electrode rod in the metallic shell.

According to a third aspect of the invention, there is provided a glow plug, comprising; a cylindrical metallic shell; an electrode rod disposed in a rear portion of the metallic shell; a heater disposed in a front portion of the metallic shell, the heater having an insulating substrate, a heating element embedded in the insulating substrate and generating heat upon energization thereof, and electric conductors connecting the heating element to the metallic shell and the electrode rod, respectively; and an electric insulator provided between an inner surface of the metallic shell and a circumferential surface of the electrode rod to keep the electrode rod insulated from the metallic shell, wherein the metallic shell has a portion caulked to the electrode rod at a location axially corresponding to the electric insulator so that the circumferential surface of the electrode rod becomes deformed to define therein a recessed portion engaged with the caulked portion with the electric insulator interposed between the caulked portion and the recessed portion so as to secure the electrode rod in the metallic shell by engagement of the caulked portion and the recess d portion

DESCRIPTION OF THE EMBODIMENTS

Figure 1:
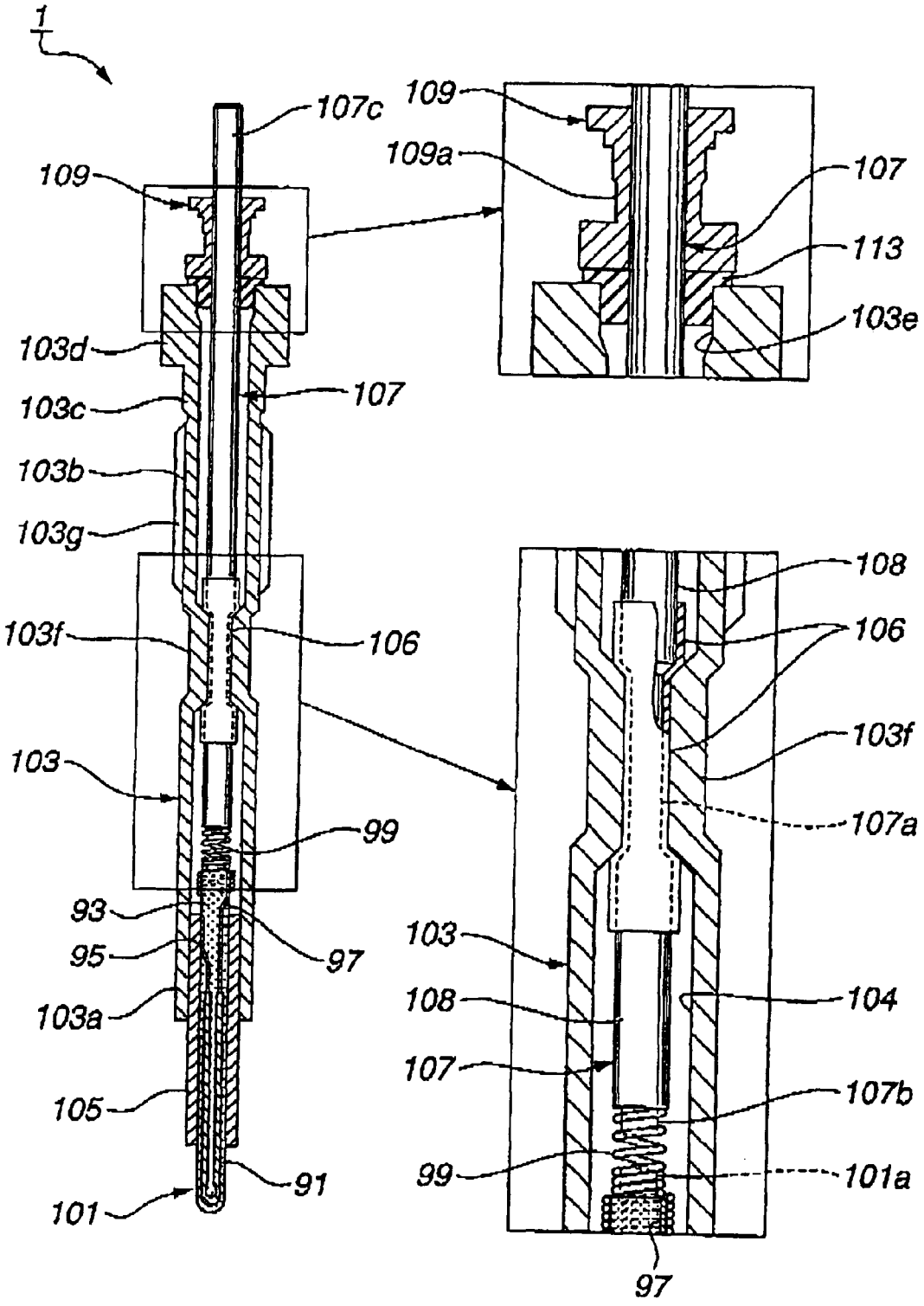
FIG. 1 is a sectional view of a glow plug according to a first embodiment of the present invention.

The present invention will be described in more detail by way of preferred embodiments. In the following description, like parts and portions are designated by like reference numerals to omit repeated descriptions thereof.

A first embodiment of the present invention will be now explained with reference to FIGS. 1, 2A and 2B.

A glow plug 1 according to the first embodiment of the invention has a cylindrical metallic shell 103, a ceramic heater 101, a metallic sleeve 105, an electrode rod 107, an electric insulator 106 and a coiled lead wire 99 as shown in FIG. 1.

The metallic shell 103 is made of e.g. carbon steel (such as S45C, SUM24L, SWCH6 or SUS430) and includes front, middle and rear straight-cylindrical parts 103*a*, 103*b* and 103*c*. In the first embodiment, the diameters of the front, middle and rear straight-cylindrical parts 103*a*, 103*b* and 103*c* are made equal to one another. A screw thread 103*g* for mounting the glow plug 1 on a cylinder head (not shown) is formed on an outer surface of the middle straight-cylindrical part 103*b*. Further, a tool engaging portion 103*d* for engaging thereon a tool (such as a torque wrench) to mount the glow plug 1 on the cylinder head is formed at a rear end of the metallic shell 103. The tool engaging portion 103*d* is shaped like a hexagonal-head bolt (although not shown in detail in the drawings) in the first embodiment. The outer diameter of the tool engaging portion 103*d* is made larger than the outer diameters of the other portions 103*a*, 103*b* and 103*c*, and the inner diameter of the tool engaging portion 103*d* is made larger at a rear end thereof to provide a sealant-installation space 103*e*.

The ceramic heater 101 is formed into a cylindrical shape and disposed in a front end portion of the metallic shell 103 with a front end of the ceramic heater 101 protruded from the metallic shell 103. The ceramic heater 101 has an insulating ceramic substrate 93, a U-shaped heating element 91 embedded in a front portion of the ceramic substrate 93 with two ends thereof facing rearward, and electric conductors 95 and 97 (made of high-melting metal) embedded in a rear portion of the ceramic substrate 93. The metallic sleeve 105 is fitted around and brazed to an axially middle portion of the ceramic heater 101, whereas a rear end portion of the metallic sleeve 105 is fitted in and brazed to the front end portion of the metallic shell 103. The electric conductor 95 has a front end electrically connected to one end of the heating element 91 and a rear end exposed at the surface of the ceramic substrate 93 and electrically connected to the metallic shell 103 via the metallic sleeve 105. On the other hand, the electric conductor 97 has a front end electrically connected to the other end of the heating element 91 and a rear end exposed at the surface of the ceramic substrate 93 and electrically connected to the electrode rod 107 via the lead wire 99.

The electrode rod 107 is made of steel (e.g. S45C) that is as soft as or softer than the steel of the metallic shell 103, and has a substantially cylindrical shape throughout its length. The electrode rod 107 is coaxially disposed in a rear portion of the metallic shell 103 such that a front end of the electrode rod 107 opposes to a rear end 101*a* of the ceramic heater 101 with some space left therebetween. A rear end 107*c* of the electrode rod 107 is protruded from the metallic shell 103 for connection to an external power source. (Hereinafter, the protruded end 107*c* of the electrode rod 107 is occasionally referred to as a "terminal") Further, the electrode rod 107 has at the front end thereof a joint portion 107*b* made in a smaller diameter so that the lead wire 99 is silver-brazed to the joint portion 107*b*.

The electric insulator 106 is provided within the metallic shell 103 to circumferentially cover an axially middle portion of the electrode rod 107. In the first embodiment, the electric insulator 106 is situated toward the front on the electrode rod 107.

Herein, the metallic shell 103 is caulked radially inwardly to the electrode rod 107 at a location axially corresponding to the electric insulator 106, thereby causing deformation in a circumferential surface 108 of the electrode rod 7 to define a caulked portion 103*f* (as a protrusion on an inner surface 104 of the metallic shell 103) and a recessed portion 107*a* (as a recess in the circumferential surface 108 of the electrode rod 107). Under caulking, the caulked portion 103*f* is made smaller in diameter than the straight-cylindrical parts 103*a*, 103*b* and 103*c*. Further, the caulked portion 103*f* may become smoothly constricted or have a polygonal shape such as a hexagonal shape or an octagonal shape when taken in transverse section (i.e. when viewed in the axial direction of the glow plug 1). The recessed portion 107*a* has a shape to fit with the caulked portion 103*f*.

The caulked portion 103*f* of the metallic shell 103 is engaged in the recessed portion 107*a* of the electrode rod 107 with the electric insulator 106 interposed between the protruded portion 103*f* and the recessed portion 107*a*. This makes it possible to secure the electrode rod 107 in the metallic shell 103 tightly while providing insulation between the metallic shell 103 and the electrode rod 107. As the electric insulator 106 is axially longer than the caulked portion 103*f* and the recessed portion 107*a*, the insulation between the metallic shell 103 and the electrode rod 107 can be established assuredly. There is some space left between the metallic shell 103 and other portions of the electrode rod 107 (i.e. portions that are not covered with the electric insulator 106) to keep the electrode rod 107 insulated from the metallic shell 103.

In order for the electric insulator 106 to be easily interposed between the caulked portion 103*f* and the recessed portion 107*a*, the electric insulator 106 is preferably in the form of either a tube made of an electrically-insulating flexible (soft) resin fitted around the electrode rod 107 or a coating of an electrically insulating flexible resin applied to the circumferential surface 108 of the electrode rod 107. The resin of the electric insulator 106 needs to be selected according to its heat resistance, strength and the like. As there is a case where the glow plug 1 becomes heated to more than 150° C., it is desirable that the resin has a heat resistance of 200° C. or higher. It is also desirable that the resin has a high degree of flexibility such that the electric insulator 106 can be readily deformed without being broken and damaged when the metallic shell 103 is caulked to the electrode rod 107 via the electric insulator 106. Examples of such electrically insulating resin include: general-purpose engineering plastics, such as polyamide, polyethylene terephthalate (PET) and polybutylene terephthalate (PBT); and super engineering plastics, such as polyimide, polyetheretherketone (PEEK) and polyphenylene sulfide (PPS). In the case of the electric insulator 106 being in tube form, a fluorocarbon resin, such as polyvinylidene fluoride, is preferably used to minimize the risk of breaking and damaging the insulating tube 106 under caulking. A commercially available electrically insulating resin tube, such as SUMITUBE K (made of polyvinylidene fluoride) manufactured by Sumitomo Electric Fine Polymer Inc. can be used as the electric insulator 106. Alternatively, the electric insulator 106 may be a silicone tube. When the metallic shell 103 and the electrode rod 107 are made of iron materials, it may be also possible to form the electric insulator 106 into an oxide coating.

Further, the thickness of the electric insulator 106 is preferably made as small as possible where the electric insulator 106 can provide proper insulation between the metallic shell 103 and the electrode rod 107 even when the electric insulator 106 gets deformed by caulking the metallic shell 103 to the electrode rod 107. Desirably, the thickness of the electric insulator 106 is controlled to 0.01 to 0.5 mm. When the thickness of the electric insulator 106 exceeds 0.5 mm. it is easier to cause deformation in the electric insulator 106 but difficult to cause deformation in the circumferential surface 108 of the electrode rod 107. For example, the thickness of the electric insulator 106 is controlled to 0.15 mm in the first embodiment.

An insulating bushing (as a sealant) 113 is pushed in the sealant-installation space 103*e* so as to be located around a rear end portion of the electrode rod 107, and a cylindrical securing member 109 is fitted around and radially inwardly caulked at a portion 109*a* to the electrode rod 107 so as to hold the bushing 113 down to the sealant-installation section 103*e*. This also makes it possible to secure the electrode rod 107 in the metallic shell 103 while keeping the electrode rod 107 insulated from the metallic shell 103.

For use of the glow plug 1, the glow plug 1 is mounted in the cylinder head by means of the screw thread 103*g* such that the front end portion of the ceramic heater 101 is located in an engine combustion chamber. Upon the passage of a current from the terminal 107*c* through the electrode rod 107, the lead wire 99, the conductor 97, the heating element 91 and the conductor 95 and then the metallic shell 103, the heating element 101 becomes energized to generate heat so as to aid full ignition in the combustion chamber.

The above-structured glow plug 1 can be manufactured by the following procedure.

Figure 2A:
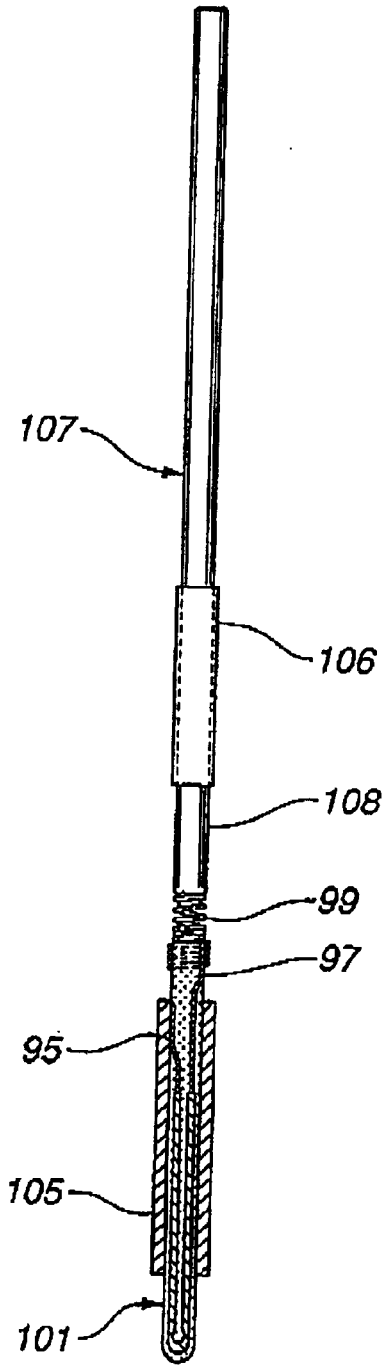
FIGS. 2A and 2B are schematic illustrations showing how the glow plug is manufactured according to the first embodiment of the present invention.

Firstly, a subassembly is prepared by arranging the electric insulator 106 around the electrode rod 107, connecting the conductor 95 to the electrode rod 107 via the lead wire 99, and then, brazing the metallic sleeve 105 onto the ceramic heater 101, as shown in FIG. 2A. In the case of the electric insulator 106 being in tube form, the electrically insulating resin tube is prepared with predetermined dimensions (such as thickness, inner diameter and length), fitted around the electrode rod 107, heated to shrink and adhered to the circumferential surface 108 of the electrode rod 107. In the case of the electric insulator 106 being in coating form, the electric insulator 106 may be formed by pasting an electrically insulating resin film, applying a liquid of electrically insulating resin material or electrostatic painting or spraying an electrically insulating resin powder.

Next, the subassembly is inserted in the metallic shell 103 and held in position such that the front end portion of the ceramic heater 101 and the terminal 107*c* of the electrode rod 107 are protruded from the metallic shell 103. Then, the metallic shell 103 is brazed onto the metallic sleeve 105. At this time, both the metallic shell 103 and the electrode rod 107 are substantially cylindrical in shape.

Figure 2B:
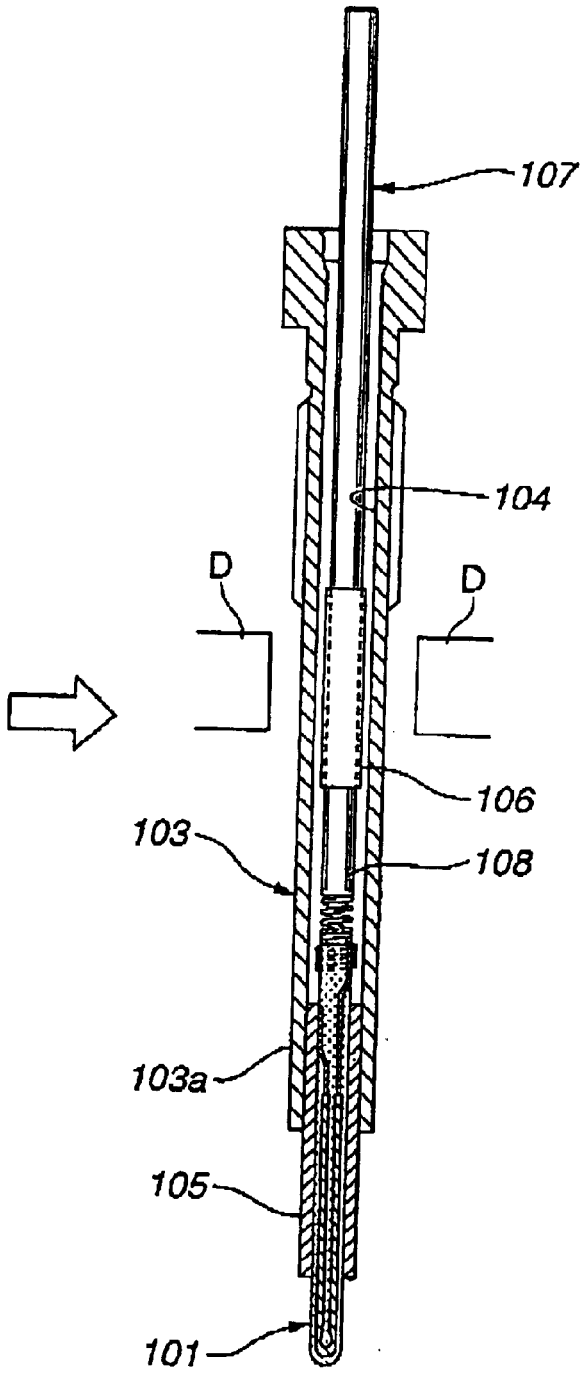

As shown in FIG. 2B, the metallic shell 103 is caulked radially inwardly to the electrode rod 107 via the electric insulator 106 by means of a pair of dies D. The pair of dies D has a shape to form the portions 103*f* and 107*a* into e.g. a hexagonal shape.

The glow plug 1 is completed by fitting the bushing 113 in the sealant-installation space 103*e* of the metallic shell 103, fitting the fixing member 109 around the terminal 107*c* of the electrode rod 107, and caulking the fixing member 109 at the portion 109*a* to hold the bushing 113 down.

As described above, the electrode rod 107 can be tightly secured in the metallic shell 103 by caulking the metallic shell 103 to the electrode rod 107 and thereby engaging the caulked portion 103*f* in the recessed portion 107*a* with the electric insulator 106 interposed between the caulked portion 103*f* and the recessed portion 107*a*. The location where the metallic shell 103 is caulked to the electrode rod 107 via the electric insulator 106 is not particularly limited, and the metallic shell 103 can be caulked to the electrode rod 107 at a location situated toward the front on the electrode rod 107. The location and area where the metallic shell 103 is caulked to the electrode rod 107 can be determined according to the length of the electrode rod 107, the required strength for securing the electrode rod 107 in the metallic shell 103, and the like. It is thus possible to improve the strength for securing the electrode rod 107 In the metallic shell 103. Even when the electrode rod 107 is axially subjected to a large external force with the metallic shell 103 fastened to the cylinder head, the electrode rod 107 is able to withstand such an axial external force. In the case where the caulked portion 103*f* and the recessed portion 107*a* are polygonal in transverse section, the electrode rod 107 is also able to withstand a radial external force. It is also possible to attain airtightness by caulking the metallic shell 103 to the electrode rod 107 via the electric insulator 106. Further, there is no need to heat-treat a glass sealant material at the final stage in the manufacturing process of the glow plug 1. The glow plug 1 can be thus designed with a higher degree of freedom.

Next, a second embodiment of the present invention will be explained with reference to FIGS. 3 and 4. A glow plug 21 of the second embodiment is structurally similar to the glow plug 1 of the first embodiment, except for the configurations of the electric insulator 106 and of the electrode rod 107.

Figure 3:
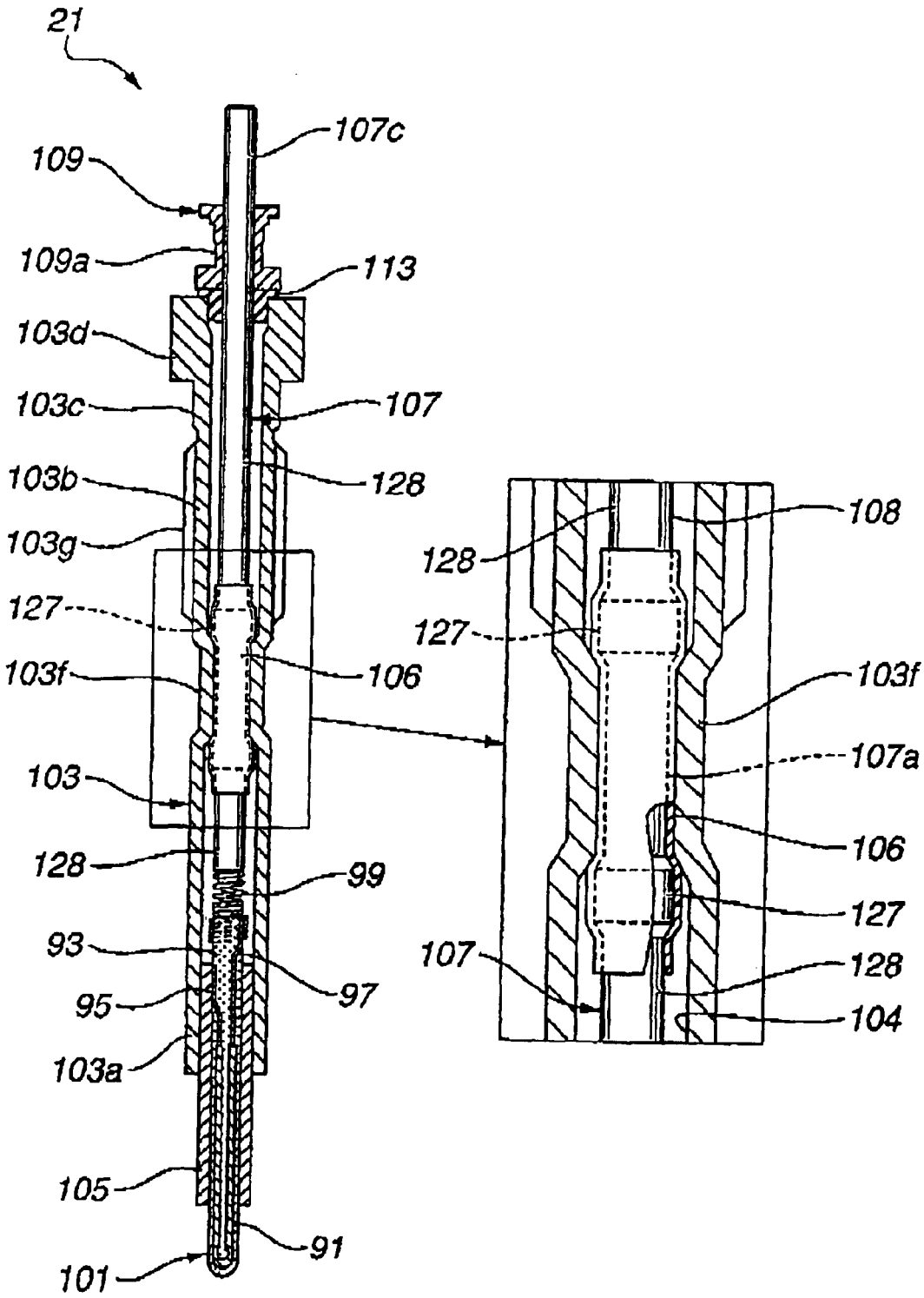
FIG. 3 is a sectional view of a glow plug according to a second embodiment of the present invention.
Figure 4:
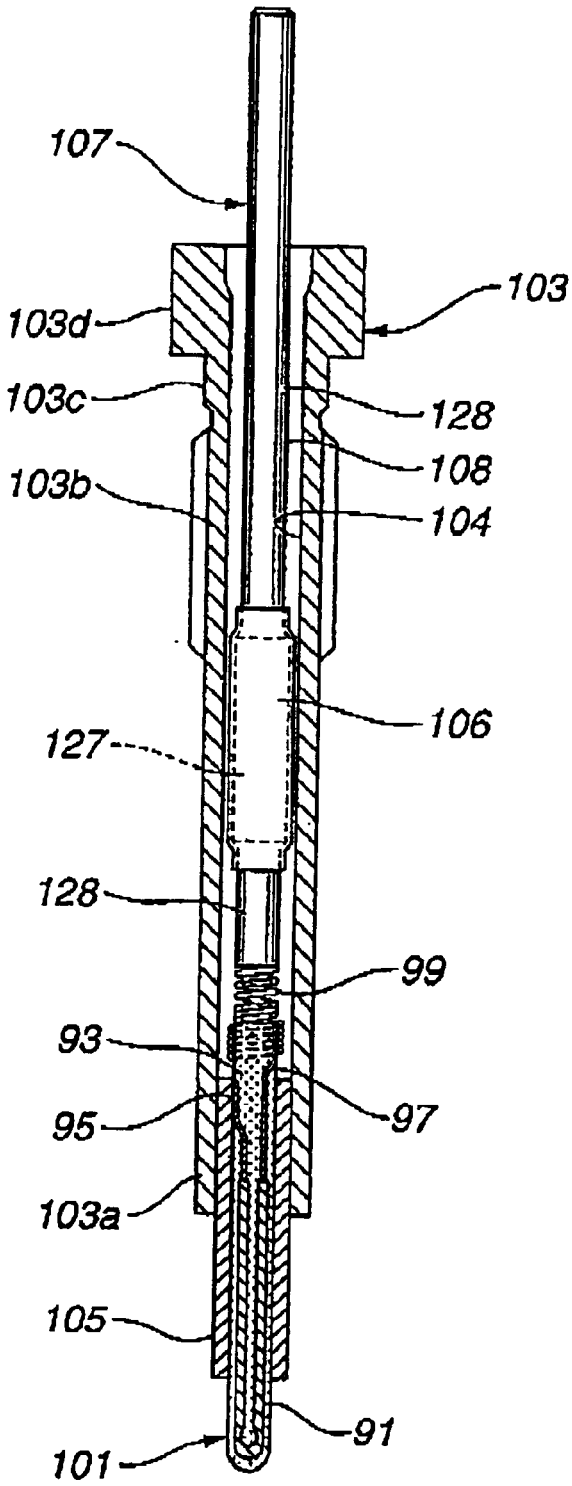
FIG. 4 is a schematic illustration showing how the glow plug is manufactured according to the second embodiment of the present invention.

As shown in FIGS. 3 and 4, the electrode rod 107 includes small-diameter parts 128 and a large-diameter part 127 between the small-diameter parts 128. Needless to say the large-diameter part 127 is made larger in diameter than the small-diameter parts 127. Each of the large-diameter part 127 and the small-diameter parts 128 has a straight cylindrical shape, and the large-and small-diameter parts 27 and 28 are aligned coaxially. The electric insulator 106 is provided to cover the large-diameter parts 127 and slightly extend over the small-diameter parts 128. The metallic shell 103 is caulked to the large-diameter part 127 of the electrode rod 107 via the electric insulator 106 so as to form the recessed portion 107*a* in the large-diameter part 127. The glow plug 21 can be manufactured in the same manner as to the glow plug 1.

In the second embodiment, it is possible to obtain not only the same effects as in the first embodiment but also the following effects.

In order for the metallic shell 103 to be easily and assuredly caulked to the electrode rod 107, there is a demand to reduce a space between the metallic shell 103 and the electrode rod 107 to a level at which the electrode rod 107 and the electric insulator 106 can be freely inserted in the metallic shell 103 and which the electrode rod 107 can be kept insulated from the metallic shell 103. With the large-diameter part 127 formed on the electrode rod 107, it becomes possible to minimize the space between the metallic shell 103 and the large-diameter part 127 of the electrode rod 107 while securing larger space between the metallic shell 103 and the other portions of the electrode rod 107 that are not covered with the electric insulator 106. Accordingly the metallic shell 103 can be caulked to the large-diameter part 127 of the electrode rod 107 more easily and assuredly without the risk to short out the electrode rod 107. Also, the electric insulator 106 can be made in a smaller thickness.

A third embodiment of the present invention will be explained with reference to FIG. 5. A glow plug 31 of the third embodiment is structurally similar to the glow plug 1 of the first embodiment, except that the metallic shell 103 is caulked to the electrode rod 107 at two locations.

Figure 5:
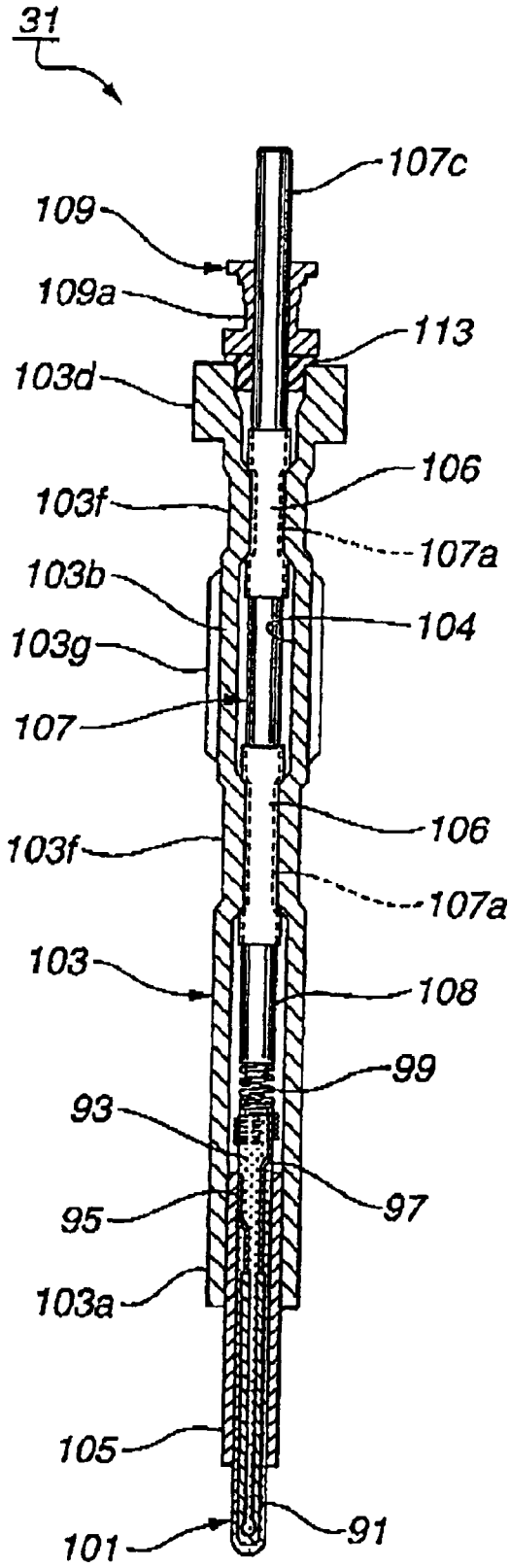
FIG. 5 is a sectional view of a glow plug according to a third embodiment of the present invention.

As shown in FIG. 5, two electric insulators 106 are provided around the electrode rod 107, and the metallic shell 103 is caulked radially inwardly to the electrode rod 107 at locations axially corresponding to the respective electric insulators 106 to defines two caulked portions 103*f* and two recessed portion 107*a*. The glow plug 31 can be manufactured in the same manner as to the glow plug 1.

Alternatively, more than two electric insulators 106 may be provided so that the metallic shell 103 is caulked to the electrode rod 107 at locations axially corresponding to the respective electric insulators 106. The area where the metallic shell 103 is caulked to the electrode rod 107 can be determined according to the locations of caulking, the number of the locations of caulking the length of the electrode rod 107, the required strength for s curing the electrode rod 107 in the metallic shell 103, and the like. Also, the electrode rod 107 may be formed with a plurality of large-diameter parts 127 so that the metallic shell 103 is caulked to the large-diameter parts 127 of the electrode rod 107 via the respective electric insulators 106.

In the third embodiment, it becomes possible to secure the electrode rod 107 in the metallic shell 103 more tightly by caulking the metallic shell 103 to the electrode rod 107 at a plurality of locations. Further, there is a case where the glow plug 31 is produced in a small diameter. In such a case, the thickness of the metallic shell 103 is often made smaller although the strength of the metallic shell 103 is lowered. It is however possible to allow the electrode rod 107 to compensate for the strength of the metallic shell 103 by caulking the metallic shell 103 to the electrode rod 107 at a plurality of locations.

Finally, a fourth embodiment of the present invention will be described with reference to FIG. 6. A glow plug 41 of the fourth embodiment is structurally similar to the glow plug 1 of the first embodiment, except that the metallic shell 103 is caulked to the electrode rod 107 at a location between the tool engaging portion 103*d* and the straight-cylindrical part 103*b* on which the thread screw 103*g* is formed.

Figure 6:
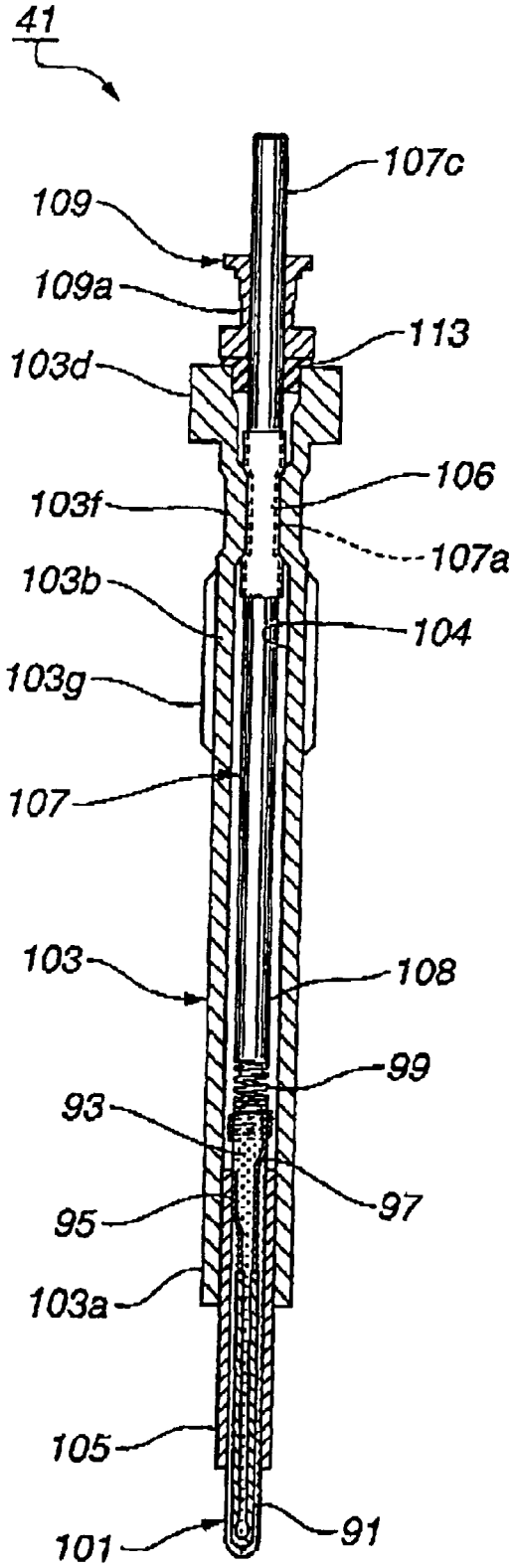
FIG. 6 is a sectional view of a glow plug according to a fourth embodiment of the present invention.
Figure 7:
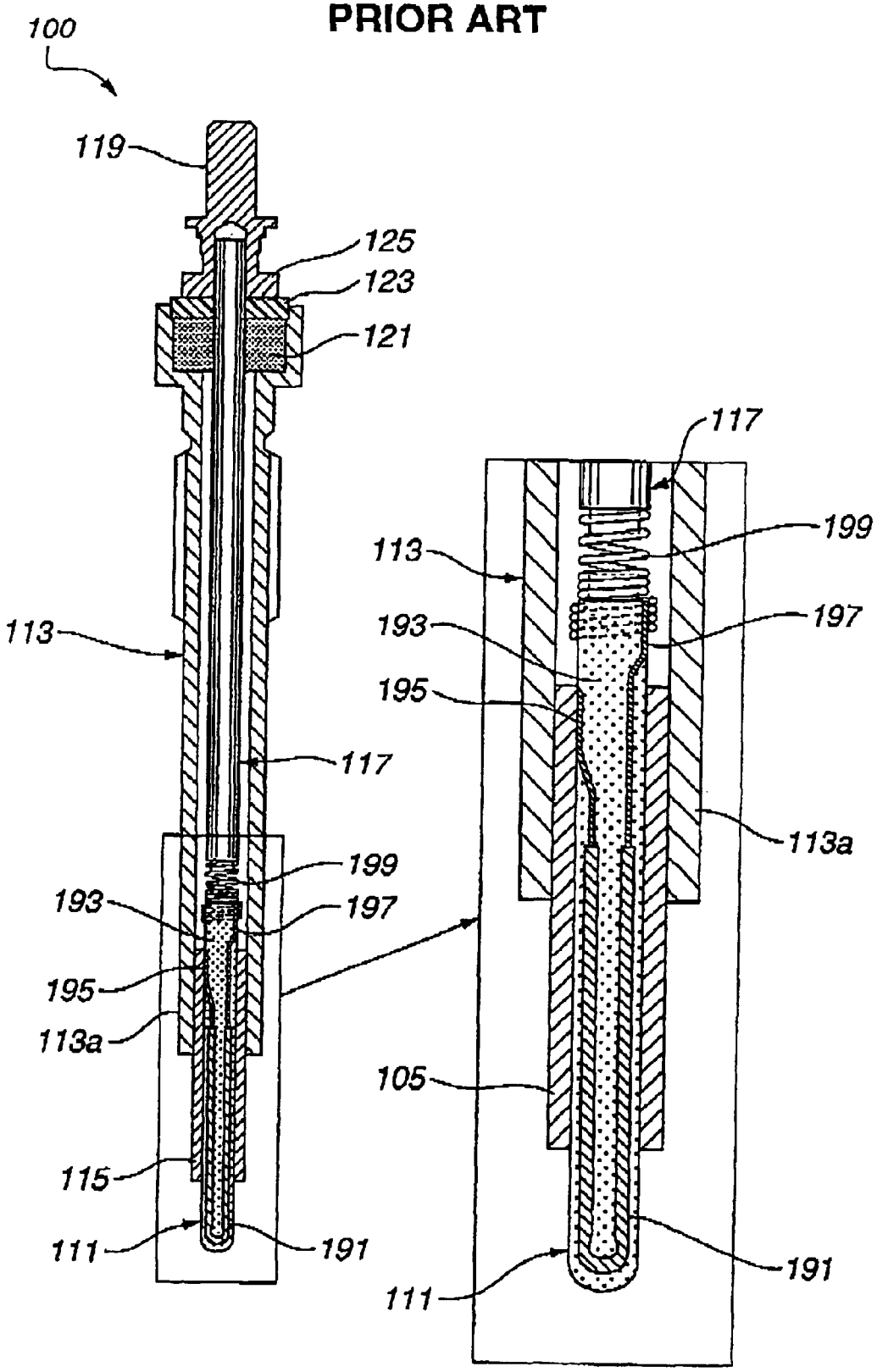
FIG.7 PRIOR ART
FIG. 7 is a sectional view of a conventional type glow plug.

As shown in FIG. 6, the electric insulator 106 is arranged at a rear side of the screw thread 103*g*. The metallic shell 103 is caulked to the electrode rod 107 via the electric insulator 106 to thereby form the caulked portion 103*f* between the straight-cylindrical part 103*b* and the tool engaging portion 103*d*. Under caulking, the circumferential surface 108 of the electrode rod 107 becomes deformed to define the recessed portion 107*a*. That is both the caulked portion 103*f* and the recessed portion 107*a* are located at the rear side of the screw thread 103*g*.

There is a possibility that the metallic shell 103 may be misaligned at the time of caulking the metallic shell 103 to the electrode rod 107. In the fourth embodiment, it is however possible to minimize such a possibility by caulking the metallic shell 103 to the electrode rod 107 at the rear side of the screw thread 103*g*. It is also possible attain a sufficient securing strength to hold the electrode rod 107 in position even when any lead member is directly or indirectly attached to and detached from the electrode rod 107.

In the above first to fourth embodiments, the metallic shell 103 is caulked to the electrode rod 107 so as to cause deformation in the electrode rod 107 and thereby define the caulked portion 103*f* and the recessed portion 107*a*. Alternatively, the electrode rod 107 may be formed with the recessed portion 107*a* in advance of assembling the metallic shell 103 and the electrode rod 107, and then, secured in the metallic shell 103 by forming the protruded portion 103*f* on the metallic shell 103 so as to engage the protruded portion 103*f* with the recessed portion 107*a*.

The entire contents of Japanese Patent Application No. 2002-234619 (filed on Aug. 12, 2002) are herein incorporated by reference.

Although the present invention has been described with reference to specific embodiments of the invention, the invention is not limited to the above-described embodiments. Various modification and variation of the embodiments described above will occur to those skilled in the art in light of the above teaching. For example, the electric insulator 106 may be provided to cover the whole of the circumferential surface 108 of the electrode rod 107. Alternatively, the electric insulator 106 may be applied to the inner surface 104 of the metallic shell 103 or to both the inner surface 104 of the metallic shell 103 and the circumferential surface 108 of the electrode rod 107. The scope of the invention is defined with reference to the following claims.

What is claimed is:

1. A glow plug, comprising:

a cylindrical metallic shell;

an electrode rod disposed in a rear portion of the metallic shell;

a heater disposed in a front portion of the metallic shell with a front end of the heater protruded from the metallic shell, the heater having:

an insulating substrate;

a heating element embedded in the insulating substrate and generating heat upon energization thereof; and electric conductors connecting the heating element to the metallic shell and the electrode rod, respectively;

a recess formed in a circumferential surface of the electrode rod;

a protrusion formed on an inner surface of the metallic shell and engaged in the recess to secure the electrode rod in the metallic shell; and an electric insulator interposed between the recess and the protrusion to keep the electrode rod insulated from the metallic shell.

2. A glow plug according to claim 1, wherein the electric insulator is a tube made of an electrically insulating resin and fitted around the electrode rod.

3. A glow plug according to claim 2, wherein the resin is a fluorocarbon resin.

4. A glow plug according to claim 1, wherein the electric insulator is a coating of an electrically insulating resin applied to the circumferential surface of the electrode rod.

5. A glow plug according to claim 1, wherein the electric insulator has a thickness of 0.01 to 0.5 mm.

6. A glow plug according to claim 1, wherein the electrode rod has a large-diameter part and a small-diameter part, and the recess is formed in the large-diameter part of the electrode rod.

7. A glow plug according to claim 1, wherein the metallic shell has a plug-mounting screw thread formed on an outer surface of the metallic shell, and the protrusion and the recess are formed at a rear side of the screw thread.

8. A glow plug according to claim 1, further comprising:

a second recess formed in the circumferential surface of the electrode rod;

a second protrusion formed on the inner surface of the metallic shell and engaged in the second recess to secure the electrode rod in the metallic shell; and a second electric insulator between the second protrusion and the second recess to keep the electrode rod insulated from the metallic shell.

9. A glow plug, comprising:

a cylindrical metallic shell;

an electrode rod disposed in a rear portion of the metallic shell;

a heater disposed in a front portion of the metallic shell with a front end of the heater protruded from the metallic shell, the heater having:

an insulating substrate;

a heating element embedded in the insulating substrate and generating heat upon energization thereof; and electric conductors connecting the heating element to the metallic shell and the electrode rod, respectively; and an electric insulator provided between an inner surface of the metallic shell and a circumferential surface of the electrode rod to keep the electrode rod insulated from the metallic shell, wherein the metallic shell is caulked to the electrode rod at a location axially corresponding to the electric insulator so as to cause deformation in the circumferential surface of the electrode rod and thereby secure the electrode rod in the metallic shell.

10. A glow plug according to claim 9, wherein the electric insulator is a tube made of an electrically insulating resin and fitted around the electrode rod.

11. A glow plug according to claim 10, wherein the resin is a fluorocarbon resin.

12. A glow plug according to claim 9, wherein the electric insulator is a coating of an electrically insulating resin applied to the circumferential surface of the electrode rod.

13. A glow plug according to claim 9, wherein the electric insulator has a thickness of 0.01 mm to 0.5 mm.

14. A glow plug according to claim 9, wherein the electrode rod has a large-diameter part and a small-diameter part, the electric insulator is provided around the large-diameter part of the electrode rod so that the deformation is caused in the large-diameter part of the electrode rod.

15. A glow plug according to claim 9, wherein the metallic shell has a plug-mounting screw thread formed on an outer surface of the metallic shell, and the electric insulator is arranged at a rear side of the screw thread.

16. A glow plug according to claim 9, further comprising one or more additional electric insulators provided between the inner surface of the metallic shell and the circumferential surface of the electrode rod, wherein the metallic shell is caulked to the electrode rod at locations axially corresponding to the respective electric insulators.

17. A glow plug, comprising:

a cylindrical metallic shell;

an electrode rod disposed in a rear portion of the metallic shell;

a heater disposed in a front portion of the metallic shell with a front end of the heater protruded from the metallic shell, the heater having:

an insulating substrate:

a heating element embedded in the insulating substrate and generating heat upon energization thereof; and electric conductors connecting the heating element to the metallic shell and the electrode rod, respectively; and an electric insulator provided between an inner surface of the metallic shell and a circumferential surface of the electrode rod to keep the electrode rod insulated from the metallic shell, wherein the metallic shell has a portion caulked to the electrode rod at a location axially corresponding to the electric insulator so that the circumferential surface of the electrode rod becomes deformed to define therein a recessed portion engaged with the caulked portion with the electric insulator interposed between the caulked portion and the recessed portion so as to secure the electrode rod in the metallic shell by engagement of the caulked portion and the recessed portion.

18. A glow plug according to claim 17, wherein the electric insulator is a tube made of an electrically insulating resin and fitted around the electrode rod.

19. A glow plug according to claim 18, wherein the resin is a fluorocarbon resin.

20. A glow plug according to claim 17, wherein the electric insulator is a coating of an electrically insulating resin applied to the circumferential surface of the electrode rod.

21. A glow plug according to claim 17, wherein the electric insulator has a thickness of 0.01 to 0.5 mm.

22. A glow plug according to claim 17, wherein the electrode rod has a large-diameter part and a small-diameter part, and the electric insulator is provided around the large-diameter part so that the deformation is caused in the large-diameter part of the electrode rod.

23. A glow plug according to claim 17, wherein the electrode rod has a plug-mounting screw thread formed on an outer surface of the metallic shell, and the electric insulator is arranged at a rear side of the screw thread.

24. A glow plug according to claim 17, further comprising one or more additional electric insulators provided between the inner surface of the metallic shell and the circumferential surface of the electrode rod, wherein the metallic shell is caulked to the electrode rod at locations axially corresponding to the respective electric insulators.

* * * * *